United States Patent [19]

Miskowicz

[11] 4,408,373

[45] Oct. 11, 1983

[54] BUCKLE WITH INTEGRAL PUSH BUTTON SPRING AND REACTION PORTIONS

[75] Inventor: John S. Miskowicz, La Porte, Ind.

[73] Assignee: Gateway Industries, Inc., Hazel Crest, Ill.

[21] Appl. No.: 183,384

[22] Filed: Sep. 2, 1980

[51] Int. Cl.[3] ..... A44B 11/26

[52] U.S. Cl. ..... 24/230 A

[58] Field of Search ..... 24/230 A, 230 AK, 230 R, 24/230 TC, 230 AL

[56] References Cited

U.S. PATENT DOCUMENTS

| | | | |
|---|---|---|---|
| 1,764,240 | 6/1930 | Blustein . | |
| 3,165,806 | 1/1965 | Lehman | 24/230 A |
| 3,378,895 | 4/1968 | Eberhart | 24/230 A |
| 3,686,720 | 8/1972 | Wehner | 24/230 A |
| 3,716,895 | 2/1973 | Fohr | 24/230 A |
| 3,760,467 | 9/1973 | Lohr | 24/230 AL |
| 3,790,994 | 2/1974 | Jakob | 24/230 A |
| 3,795,030 | 3/1974 | Yates et al. | 24/230 AL |

*Primary Examiner*—Robert P. Swiatek

*Attorney, Agent, or Firm*—Fitch, Even, Tabin & Flannery

[57] ABSTRACT

A seat belt buckle for a child's seat is formed of an inexpensive construction having a latching member with an integral push-button, latch dog, and return spring formed from a single piece of spring steel. The buckle body may be molded in one piece of plastic with a central cavity to receive the latching member and grooves or tracks in the plastic body guiding and holding the tongue plate for latching engagement with the latch dog. Interlocking portions of the latching member and the buckle body hold the assembled buckle components together. For heavier load conditions, a metal insert may be added to the buckle body to assist in transferring tensile loads from the tongue plate and through the latching member to an anchor member for the buckle.

15 Claims, 5 Drawing Figures

BUCKLE WITH INTEGRAL PUSH BUTTON SPRING AND REACTION PORTIONS

This invention relates generally to belt buckles and more particularly to safetybelt buckles which are used to fasten safetybelts about the occupants in vehicles.

The present invention is particularly directed to a very small, inexpensive and lightweight safety buckle which may be used with children harnesses, children safety seats or other child restraint devices in which the load being applied to the safetybelt buckle is substantially less than the load which must be borne by safetybelt buckles used for securing adults with seatbelts at the time of a vehicle accident. Presently, there are several forms of buckles which may be and are being used with various children's safety seats or safetybelt harnesses. Typically, such buckle arrangements are either not of the pushbutton kind, whereas the buckles commonly used by the other passengers in the vehicle are of the push kind or they are elaborate buckles formed of many pieces at a considerable cost.

Thus, there is a need for a very simple and inexpensive pushbutton buckle for use with children's seats or the like which provides the ease and economy operation of a pushbutton buckle and includes a buckle body having an internal latching dog for latching engagement with a tip or tongue plate connected to a seatbelt or the like. Such an assembly is latched automatically merely by inserting the tongue plate through an entry slot and into the position for latching engagement with the latching dog. Release of the buckle is accomplished quickly and effortlessly by depressing the pushbutton to shift the latch dog from latching engagement with the tip whereby the tip may be pulled from the buckle body.

The above-description of the buckle is of a preferred embodiment which preferably comprises only two pieces, namely, a latching means and a one-piece molded plastic buckle body. It is contemplated by the present invention, however, that the present invention may be used to withstand heavier loads by the addition of a reinforcing insert in the buckle body which can be used to transmit the tension load from the latching means across the plastic buckle body to the other end of the buckle which is secured to a belt section or to a rigid connection to the vehicle.

Accordingly, the general object of the present invention is to provide a new and improved seatbelt buckle of the foregoing kind.

A further object of the invention is to provide a seatbelt buckle formed with an integral pushbutton and latch dog member mounted within a cavity of a plastic buckle body to form a two-piece pushbutton seatbelt buckle.

These and other objects of the invention will become apparent from the following detailed description taken in conjunction with the accompanying drawings in which.

Figure 1:
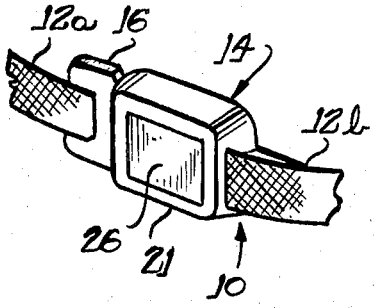
FIG. 1 is a perspective view of a seatbelt assembly constructed in accordance with the preferred embodiment invention.
Figure 2:
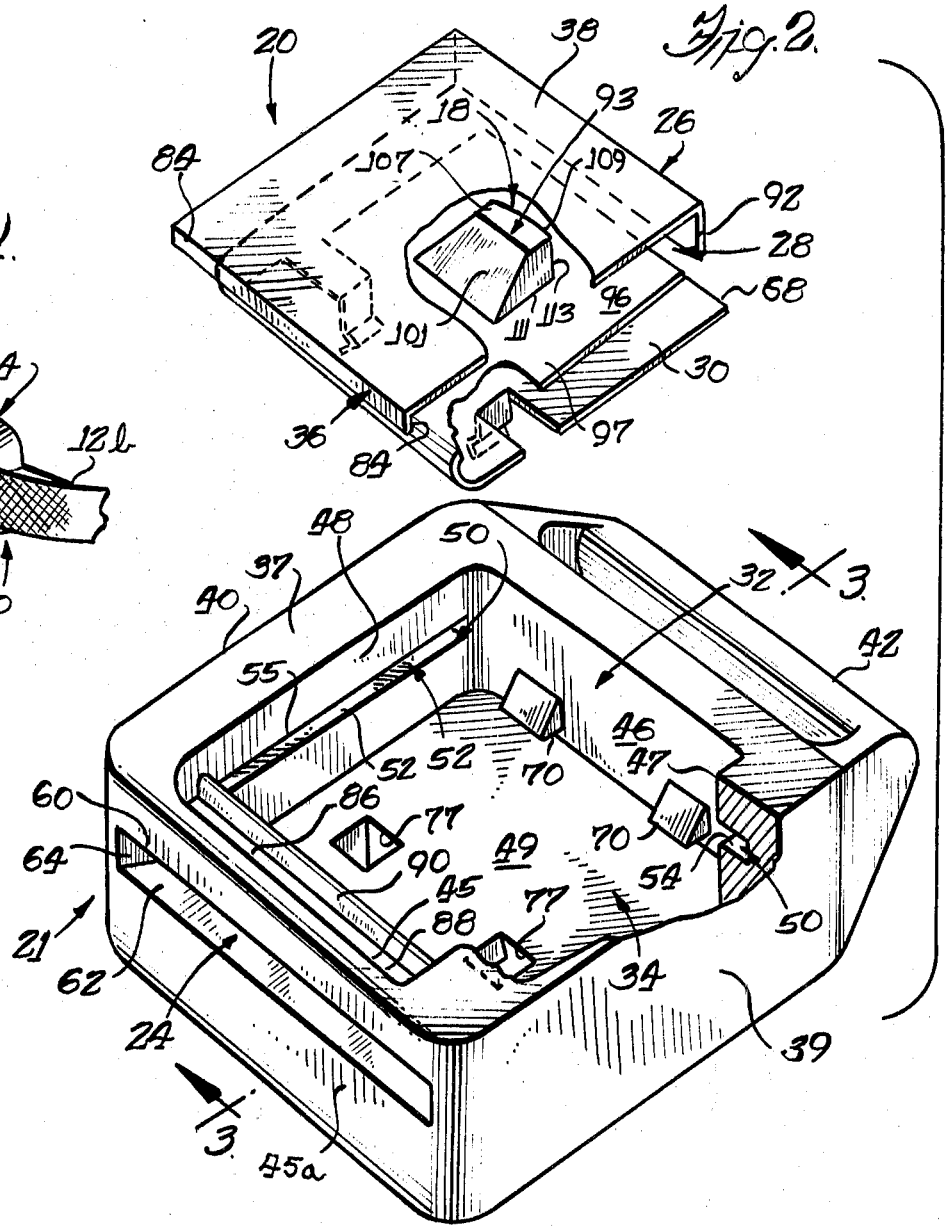
FIG. 2 is an exploded perspective view of the seatbelt buckle shown in FIG. 1.

As shown in the drawings for purposes of illustration, the invention is embodied in a safetybelt buckle assembly 10 having two belt sections 12*a*and 12*b*; a buckle 14; and a tongue plate 16. The buckle 14 and tongue plate 16 releasably secure the belt sections together although the buckle 14 may be secured directly to the vehicle without a belt section 12*b*. The tongue plate 16 (FIG. 3) is usually an elongated generally planar member having an opening 19 adjacent its leading tip end or section 22 for latching engagement with a latch dog 18 of a latching means 20 mounted in a buckle body 21. The tongue plate or tip 16 is inserted through an opening or slot 24 in a front wall 45*a* of the buckle body 21 into latching engagement with the latching dog 18. To release the tongue plate for disconnection from the buckle body, a pushbutton is pushed downwardly to shift the latch dog 18 downwardly to a release position shown in dotted lines in FIG. 3 in which the tongue plate can be pulled through the slot for disconnection from the buckle 14.

The present invention is particularly directed to a low cost buckle having relatively few parts which can be readily assembled. Typically, buckles such as shown in Romanzi, Jr. U.S. Pat. No. 4,064,603 are constructed of a number of separate components such as a latch lever, a return spring, a buckle body and one or more covers. The assembly operation includes the fastening of the spring to the buckle body, the manipulation of the latch lever into a pivotal position in the buckle body, followed by attachment of one or more covers to the buckle body. Such a buckle has been widely produced, meets current safety standards and is competitively priced. Some other presently produced buckles use a plastic buckle housing having an internal cavity into which several load bearing metal parts are dropped along with a separate, discrete spring, a separate discrete latch lever, and a separate discrete pushbutton. Other buckles have used die cast buckle bodies into which have been dropped a number of pushbutton, spring and latch lever components. The present invention is directed to a simplified buckle, which in its preferred form, may be used for buckling operations requiring less load requirements, that is, to secure babies or children in safety seats or safety harnesses. In such applications, the buckle need not hold the heavy loads that the safetybelt buckles used to hold adults must bear. As will be explained, the present invention may also be used to hold heavier loads by the addition of load carrying inserts in the buckle.

Figure 3:
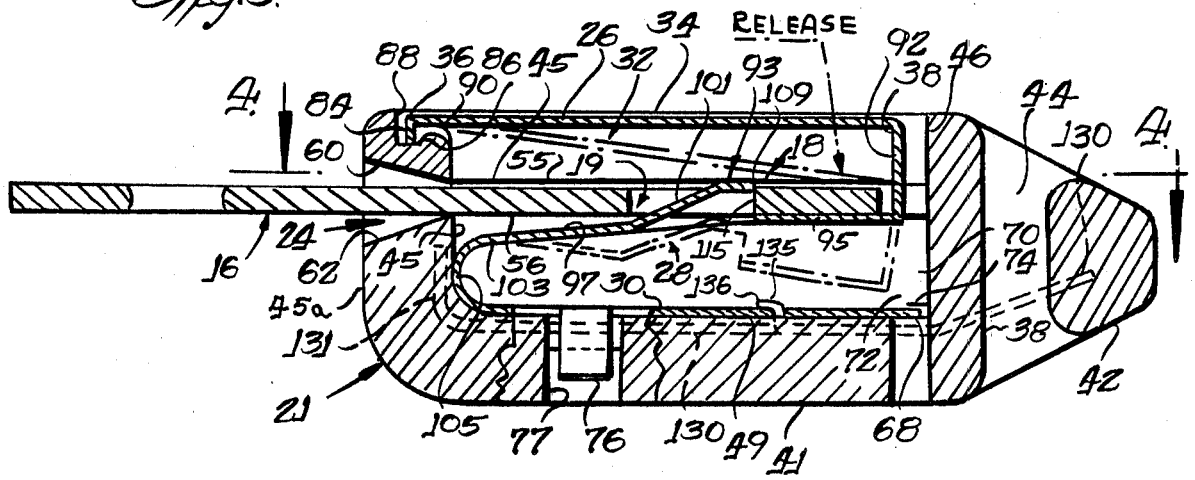
FIG. 3 is a sectional view taken through the buckle and enlarged generally along the line 3—3 of FIG. 1.

In accordance with the present invention, the preferred buckle 14 is formed only two components, the first being a one-piece, spring metal latching means 20 which includes a pushbutton portion 26, an integral latch dog 18, a flexible spring or intermediate portion 28 carrying the latch dog, and a base or reaction portion 30, and the second component being a buckle body 21 with a large cavity 32 for receiving the one-piece latching means. Herein, the buckle body is formed in a low cost manner by being formed of a one-piece molded plastic body. As will be explained, latching means 20 and plastic body 21 have interlocking portions which hold the assembled parts together. The preferred and illustrated latching means 20 is a substantially Z-shaped member having a flat, horizontal pushbutton portion 26 overlying and covering the top opening 34 of the cavity 32. The pushbutton is pivotally mounted at one end 36 to the buckle body and the other end 38 is free to swing down as shown in FIG. 3 to lower the latch dog 18, as shown in dotted lines, with the intermediate portion 28 being flexed, the flexed portion automatically returning the latch dog and the pushbutton to the solid line portion of FIG. 3 with release of the pushbutton.

Referring now in greater detail to the components of the buckle, the preferred buckle body 21 is formed of molded plastic in a generally block shape with the cavity 32 being centrally disposed therein and opening upwardly into a top wall 37. The exterior of the buckle body comprises the front vertical wall 45*a* and a parallel rear wall 38 and a pair of upstanding sidewalls 39 and 40. Generally, parallel to the top wall 37 is a bottom wall 41 which is generally imperforate. Integrally molded at the rear wall 38 of the buckle body is an integral connecting loop portion 42 defining a slot 44 through which is inserted the belt end section 12*b* to interconnect the latter to the buckle body.

The illustrated cavity 32 is defined by four vertical sidewalls with a front sidewall 45 parallel to a rear sidewall 46 and a pair of opposing sidewalls 47 and 48 extending between the front and rear walls. A bottom wall 49 for the cavity is generally flat and horizontal and receives the lower or reaction base portion 30 of the latching means 20. The preferred top opening 34 for the cavity is generally rectangular in shape.

Figure 4:
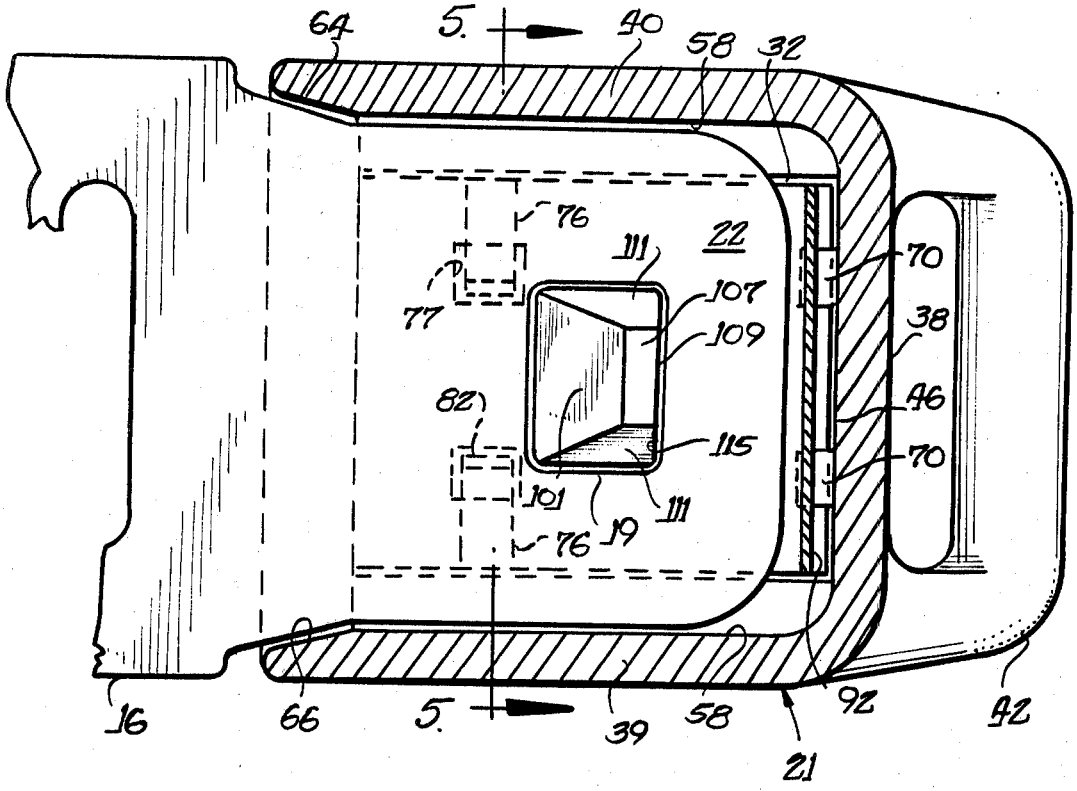
FIG. 4 is an enlarged plan view with a section taken generally along the line 4—4 of FIG. 3.
Figure 5:
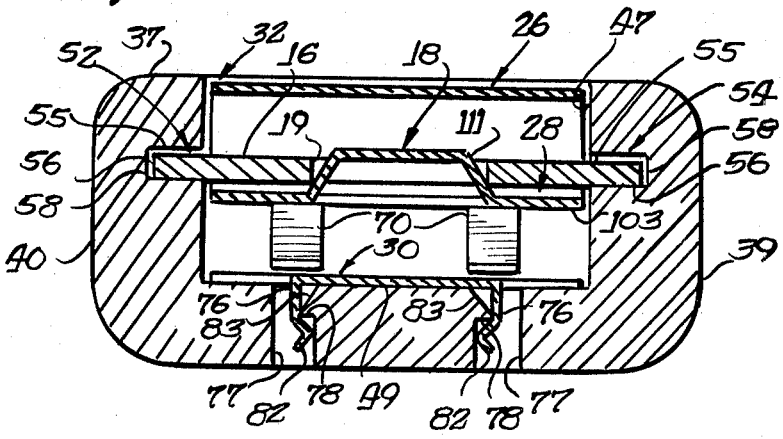
FIG. 5 is a sectional view taken generally along the line 5—5 of FIG. 4.

To hold the tongue plate 16 against twisting or turning from engagement with the latch dog 18, the tongue plate is guided and held into its latching position in the buckle by a guide track means 50 in the buckle body. Preferably, the track means is in the form of a pair of horizontally disposed slots 52 and 54 in the cavity sidewalls 47 and 48 extending from the entry slot 24 rearwardly to the rear cavity wall 46. The edges of the tongue plate will be rigidly held in these slots 52 and 54. As best seen in FIG. 5, each slot is defined by upper and lower, horizontal surfaces 55 and 56 spaced apart a distance slightly greater than the thickness of the tongue plate 16 to allow easy sliding of the tongue plate. These slot surfaces 55 and 56 are sufficiently close together that they retain the tongue plate substantially horizontal, i.e., parallel to the wall 37 of the buckle. Preferably, the track means 50 has a width as defined by vertical slot walls 58 which is just slightly larger than the width of the tongue plate, as best seen in FIGS. 4 and 5. The holding of the tongue plate and the guiding of the tongue plate insertion toward the latch dog 18 assures that the tongue plate 16 will readily latch and yet not readily unlatch from the latch dog with turning torques or lifting or lowering forces applied to the other end of the tongue plate located externally of the buckle body 21.

To assist in guiding the leading tip 22 of the tongue plate 16 into the track means, the entry slot 24 is preferably formed with slanted upper and lower walls 60 and 62 (FIG. 3) which taper toward each other in the rearward direction from the front wall 30 of the buckle. These tapered slot walls interface with the upper and lower surfaces 55 and 56 of the track means 50 to define a continuous smooth guiding of the tongue tip into a horizontal disposition within the buckle despite a slight canting of the tongue plate to the horizontal when the tip is presented to entrance of the entry slot 24. As best seen in FIG. 4, vertical end walls 64 and 66 of the entry slot 24 are also slanted toward each other in the rearward direction to define a larger width opening at the entrance of the entry slot 24 than at the inner end where the slanted walls merge with the track means vertical walls 58.

The preferred and illustrated latching means 20 is assembled and interlocked with the buckle body 21 merely by inserting the same into cavity and forcing the interlocking portions in locking engagement. More specifically, a lower free end 68 of the reaction portion 30 is positioned to engage the bottom cavity wall 49 and to slide beneath a pair of interlocking projections 70 projecting forwardly from the rear cavity wall 46, the projections 70 spaced slightly above the cavity bottom wall 49 as best seen in FIG. 3. To assist this insertion, the projections have a front side 72 slanted downwardly and rearwardly for sliding engagement with the leading edge 68 of the reaction portion 30. An attempted lifting of the latch means 20 is resisted by the engagement of the top side of the leading edge 68 with the underside 74 of the projections 70.

A further interlocking engagement between the latch means 20 and the buckle body 21 is achieved by flexible locking projections or detent tabs 76 integrally formed on the reaction portion 30 for locking engagement with projections 77 and the buckle body. Herein, a pair of small, downwardly bent integral metal detent tabs 76 are struck downwardly from opposite sides of the reaction portion to extend perpendicular thereto. The small detent tabs are flexible in that they may be flexed outwardly as the tabs are pushed downwardly into the aligned openings 77 which extend from the cavity bottom wall 49 through the buckle body to the bottom wall 41 of the buckle base. Within the openings are interlocking projections (FIG. 5) which have downwardly and outwardly inclined cam surfaces which terminate at horizontally disposed shoulders 78. The shoulders are located to receive thereunder the interlocking projection or detent 82 on a tab 76. Thus, as the tabs are inserted into the openings, the detents 82 slide along the inclined camming surfaces 83 and flex the tabs outwardly until the detents 82 come to the shoulders 78 which allow the tabs to flex inwardly, the detents 82 with the tabs assuming their normal unflexed positions when the detents are below the shoulders 78. Thus, the detents 82 abut the shoulders 78 and prevent lifting of the tabs and reaction portion 30 from the bottom cavity wall 49. Thus, with the forward edge 68 of the reaction portion locked under the projections 70 and the tabs 76 locked to the shoulders 78 the reaction portion 30 will be held flat and tight against the cavity bottom wall 49.

The preferred latching means 20 is made by bending a one-piece sheet of spring metal into a substantially Z-shaped body. The Z-shaped spring body is sized to fit snugly within the cavity 32 with the pushbutton portion 26 substantially flush or slightly below the plane of the top wall 37 of the buckle body when the reaction portion is laying on the cavity bottom wall 49.

To provide a pivot action for the pushbutton, the forward end 36 of the pushbutton portion is downturned to form a flange 84 and the flange fits within a channel 86 formed within the upper buckle wall 37 adjacent the cavity opening 34. The flange receiving channel is formed by a forward vertical wall 88 and a parallel wall 90 having a rounded upper edge to be abutted by the adjacent portion of the pushbutton when it is pivoted and the intermediate portion of the latching means is flexed (see the phantom illustration in FIG. 3), caused by a manual depression of the pushbutton. At the rearward end 38 of the pushbutton is a downwardly extending vertical section 92 which is joined at its lower end to the intermediate portion 28 which carries the latch dog 18.

The latch dog 18 is integrally formed from the spring metal of the intermediate portion 28 by a portion upstruck by a die to form a generally domed or trapezoidal shaped portion in the center of the otherwise flat surface 96 and a forward flat surface 97. The latter is inclined gently upwardly and rearwardly, as shown in solid lines in FIG. 3, to the latch dog 18. On insertion, the tongue tip 22 will hit an inclined camming surface 101 on latch dog and bend the intermediate portion 28 downwardly about the forward end 103 of the intermediate section at a curved bend 105 which joins the intermediate portion 28 to the reaction portion 30. The top 107 of the latch dog is preferably flat with the tongue tip sliding thereover until the tongue opening 19 reaches the latch surface 109. The latch dog also includes upwardly inclined sidewalls 111 which have vertical rear latch surfaces 113 which cooperate with the latch surface 109 to abut in latching engagement a wall 115 defining one side of the tongue opening 19. The dome shaped configuration provides the desired rigidity to the latch dog 18.

When the latch dog is in the latching position, as shown in solid lines in FIG. 3, the rear flat surface 95 of the intermediate portion is abutting the underside of the tongue 16 which is being held in a horizontal position by the track means 50. Any tension applied to the tip will try to shift the entire latching means to the left as viewed in FIG. 3 with the bend 105 abutting the cavity front wall 45. Since the flat surface 97 is substantially horizontal, most of the load will be applied from the dog through the latter to the buckle's cavity wall 45. Whatever component of the load is tending to lift and to pivot the latching means 20 about the bend 105 will be resisted by the latch plate engaged in the track means 50.

As noted above, the upper pushbutton portion 26 of the latching means 20 is exposed so that the restrained occupant can manually depress the pushbutton to flex the intermediate or spring portion 28 carrying the dog 18 about the bend 105 to lower the dog 18 from tongue tip opening 19 (see phantom illustration in FIG. 3) and hence from latching engagement with the tongue 16 to disengage or open the buckle means 14 and allow the tongue 16 to be removed from the buckle.

It will be appreciated that the buckle body 21 could be made of other materials such as die cast metal but this would add considerably to the weight and to the cost thereof. To make the buckle withstand higher loads, it is also possible to provide a steel insert 130 shown in dotted lines in FIG. 3 having a forward flange 131 located behind the bend 105 to take the tensile load being applied to the forward cavity wall 45. The insert extends across the base of the buckle to the rear wall and to the loop 42 so that the entire tensile load may be passed by the steel insert 130 across the buckle body to a strap or other means at this rearward end of the buckle. Thus, the load may pass from tongue plate 16 and through latch dog 18 to the intermediate section's bend 105 to the steel insert 130 and from the latter to the attachment at the rear end of the buckle. The insert 130 is preferably embedded in the plastic although it may be inserted directly into the cavity and not embedded in the plastic.

To further aid in anchoring the spring metal latching means 20 to the buckle body 21 the steel insert 130 may be formed with an upstruck integral hooked end 135 (FIG. 3) with a horizontal extending end 136 overlying the reaction portion 30. A suitable opening is formed in the central area of the reaction portion 30 to allow the hooked end 135 to be inserted to a position to overlie the reaction portion 30. Thus, the hooked end 135 will aid in holding the latching means in the buckle body 21.

That is to say, it is preferred to provide the insert 130 molded within the buckle body although, of course, the insert could be inserted as a component into the cavity and not be directly molded within the buckle as illustrated herein. The insert 130 is preferably of steel or other material which can take high tensile loads better than the molded plastic material used for the buckle body 21.

It is to be understood that, while the preferred embodiment invention has a buckle formed of only two pieces with integral retaining and interlocking portions on these two pieces, it is within the purview of the present invention to use fasteners or other more positive fastener means for securing the latching means and buckle body together. The preferred pushbutton means 26 does not bear any decal or other identifying indicia thereon although such may be provided within the purview of the invention. Also, it is to be understood that the preferred track means is shown to be continuous and that such may be interrupted and formed with various different and discrete surfaces for guiding and holding the tongue plate against twisting from latching engagement. Also, it is to be understood that the configuration of the buckle base, the cavity and/or the Z-shaped latching means may be changed considerably while still operating in accordance with the principles of the present invention as expressed by the appended claims.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A seat buckle for latching engagement with a tongue plate, said buckle consisting essentially of two pieces and comprising:

a substantially one-piece plastic body having a downwardly opening cavity;

a one-piece latch means of spring metal having an integral pushbutton portion, an integral latch portion, and integral spring portion and an integral reaction portion positioned in said cavity;

a front wall on said plastic body having a slot extending into said cavity for receiving a tongue plate for sliding entry into said cavity;

an integral latch dog on said latch portion movable between a latching position for latching engagement with said tongue plate and a release position for releasing the tongue plate for withdrawal from said slot, said latch portion being flexed by said integral spring portion with depression of said pushbutton portion relative to said reaction portion to shift said latch dog from said latching position to said release position, said body of said buckle being block-shaped with a top wall and with said downwardly opening cavity being defined by four vertically extending cavity walls, said body having a lower bottom wall with an interior surface defining the bottom of said cavity, said integral reaction portion lying on said bottom interior surface and extending thereacross and in contact therewith, said integral reaction portion reacting on said bottom wall when said pushbutton is depressed, and said integral pushbutton portion of said one-piece latch means extending substantially horizontally across the open top of said cavity and being in substantially the same general horizontal plane as the plane of the body top wall.

2. A buckle in accordance with claim 1 in which said cavity extends from the top wall of said plastic body and said pushbutton portion extends substantially across the top of said cavity and covers the same.

3. A buckle in accordance with claim 2 in which said reaction portion is located at the bottom of said cavity and said latch portion includes a diagonal portion extending between said pushbutton portion and said reaction portion.

4. A buckle in accordance with claim 1 including interlocking portions on said latch means and said body to hold said latch means against removal from said body.

5. A buckle in accordance with claim 4 in which said interlocking portions comprise flexible tabs on said latch means for engagement with integral plastic projections in said plastic body.

6. A buckle in accordance with claim 4 in which said interlocking portions comprise an overhead projecting shoulder in a wall of said cavity and a portion of said reaction member positioned below said shoulder to limit upward movement of said portion of said reaction member.

7. A buckle in accordance with claim 1 in which said latch portion includes a substantially flat portion located rearwardly of said integral latch dog to receive the end of the tongue plate thereon.

8. A buckle in accordance with claim 1 in which said pushbutton portion has one end pivotally mounted at a forward end of said buckle.

9. A seat buckle for latching engagement with a tongue plate, said buckle consisting essentially of two pieces and comprising:

a substantially one-piece plastic body having a downwardly opening cavity;

a one-piece latch means of spring metal having an integral pushbutton portion, an integral reaction portion, and an integral latching portion disposed in said cavity;

a front wall on said buckle body having an opening extending into said cavity for receiving a tongue plate for sliding entry into said cavity;

guide means formed in said buckle body on opposite sides of said cavity for guiding and holding said tongue plate in a predetermined planar position;

an integral latch dog on said latching portion movable between a latching position for latching engagement with said tongue plate and a release position for releasing the tongue plate for withdrawal from said guide means and said slot; and flexible integral spring portion of said latch means being flexed by said pushbutton portion to shift said latch dog from said latching position to said release position, said body of said buckle being block-shaped with a top wall and with said downwardly opening cavity being defined by four vertically extending cavity walls, said body having a lower bottom wall with an interior surface defining the bottom of said cavity, said integral reaction portion lying on said bottom interior surface and extending thereacross and in contact therewith, said integral reaction portion reacting on said bottom wall when said pushbutton is depressed, and said integral pushbutton portion of said one-piece latch means extending substantially horizontally across the open top of said cavity and being in substantially the same general horizontal plane as the plane of the body top wall.

10. In a safety belt assembly, the combination comprising:

a buckle body having spaced front and rear, side, and upper and lower walls defining a cavity; an opening in said front wall to admit a tongue plate, mutually facing track means formed on said side walls; said track means being lined up with the front wall opening and extended toward the rear wall whereby the tongue plate can be inserted through the front wall opening and into the body cavity and be laterally guided and held therein by the track means; a Z-shaped spring latch means having a pair of end legs and an intermediate leg interconnecting same, said spring latch means being positioned in the cavity of the body with the lower leg adjacent the lower body wall and the upper leg generally across the cavity opening, a latch dog formed on the intermediate leg for latching engagement with the tongue plate when the tongue plate is inserted fully into the body cavity, said upper end leg being depressable into the cavity to flex the spring and displace the intermediate leg to disengage the latch dog from latching engagement with the tongue plate.

11. A buckle assembly according to claim 10, comprising projection means formed on the body rear wall closely overlying one end of the lower end leg of the spring latch means when the latter is positioned in the body cavity.

12. A buckle assembly according to claim 10, wherein the upper end leg cooperates at its one end with the upper body wall to in effect pivot thereabout upon manual depression of the upper end leg in order to release the tongue plate.

13. A seat buckle for latching engagement with a tongue plate, said buckle comprising:

a molded plastic body having a downwardly opening cavity;

a one-piece latch means of spring metal having an integral spring portion, an integral reaction portion, and integral pushbutton portion and an integral latching portion being disposed in said cavity;

a front wall on said plastic body having a slot extending into said cavity for receiving a tongue plate for sliding entry into said cavity;

an integral latch dog on said latching portion movable between a latching position for latching engagement with said tongue plate and a release position for releasing the tongue plate for withdrawal from said slot, said latching portion being flexed by said integral spring portion with depression of said pushbutton portion relative to said reaction portion to shift said latch dog from said latching position to said release position; and a metal insert in said molded plastic body for receiving a load from said latch means and for transmitting the load across the buckle body to another means external of the buckle, said body of said buckle being block-shaped with a top wall and with said downwardly opening cavity being defined by four vertically extending cavity walls, said body having a lower bottom wall with an interior surface defining the bottom of said cavity, said integral reaction portion lying on said bottom interior surface and extending thereacross and in contact therewith, said integral reaction portion reacting on said bottom wall when said pushbutton is depressed, and said integral pushbutton portion of said one-piece latch means extending substantially horizontally across the open top of said cavity and being in substantially the same horizontal plane as the plane of the body top wall.

14. A seat buckle for latching engagement with a tongue plate, said buckle comprising:

a substantially one-piece plastic body having a downwardly opening cavity;

a one-piece latch means of spring metal having an integral pushbutton portion, an integral latch portion, and integral spring portion and an integral reaction portion positioned in said cavity;

a front wall on said plastic body having a slot extending into said cavity for receiving a tongue plate for sliding entry into said cavity;

an integral latch dog on said latch portion movable between a latching position for latching engagement with said tongue plate and a release position for releasing the tongue plate for withdrawal from said slot, said latch portion being flexed by said integral spring portion with depression of said pushbutton portion relative to said reaction portion to shift said latch dog from said latching position to said release position, said latch means being a substantially Z-shaped member having a substantially upper flat horizontal pushbutton portion covering the top of said cavity and a substantially flat reaction portion at the bottom of said cavity.

15. A buckle in accordance with claim 14 in which one end of said pushbutton portion is pivotally mounted on said buckle body and the other edge of said pushbutton swings about said pivotally mounted end.

* * * * *